US008815147B2

(12) United States Patent
Kubota et al.

(10) Patent No.: US 8,815,147 B2
(45) Date of Patent: Aug. 26, 2014

(54) COLD DIE STEEL EXCELLENT IN CHARACTERISTIC OF SUPPRESSING DIMENSIONAL CHANGE

(75) Inventors: Kunichika Kubota, Yasugi (JP); Hideshi Nakatsu, Yasugi (JP); Shugo Komatsubara, Higashiizumocho (JP)

(73) Assignee: Hitachi Metals, Ltd., Tokyo (JP)

( * ) Notice: Subject to any disclaimer, the term of this patent is extended or adjusted under 35 U.S.C. 154(b) by 327 days.

(21) Appl. No.: 12/343,923

(22) Filed: Dec. 24, 2008

(65) Prior Publication Data

US 2009/0120540 A1 May 14, 2009

Related U.S. Application Data

(63) Continuation of application No. 10/538,367, filed as application No. PCT/JP03/16392 on Dec. 19, 2003, now abandoned.

(30) Foreign Application Priority Data

Dec. 25, 2002 (JP) ..... 2002-373727

(51) Int. Cl.

| | |
|---|---|
| ***C22C 38/08*** | (2006.01) |
| ***C22C 38/46*** | (2006.01) |
| ***C22C 38/12*** | (2006.01) |
| ***C22C 38/18*** | (2006.01) |
| ***C22C 38/00*** | (2006.01) |
| ***C22C 38/44*** | (2006.01) |
| ***C21D 8/02*** | (2006.01) |
| ***C21D 8/00*** | (2006.01) |

(52) U.S. Cl.

USPC ..... 420/112; 420/109; 420/110; 420/113; 420/115; 148/333; 148/335; 148/547; 148/654

(58) Field of Classification Search

USPC ..... 420/34, 42, 60–63, 104, 109, 110, 112, 420/113, 115; 148/325, 332, 336, 333, 335, 148/547, 654

See application file for complete search history.

(56) References Cited

FOREIGN PATENT DOCUMENTS

| | | | | |
|---|---|---|---|---|
| EP | 1 072 691 | A2 | | 1/2001 |
| EP | 1 072 691 | A3 | | 1/2002 |
| JP | 52-18419 | A | | 2/1977 |
| JP | 62-211351 | A | | 9/1987 |
| JP | 62-263922 | A | | 11/1987 |
| JP | 01-11945 | A | | 1/1989 |
| JP | 8100239 | | | 4/1993 |
| JP | 11092871 | | | 4/1999 |
| JP | 11279704 | | | 10/1999 |
| JP | 2000144339 | A | * | 5/2000 |
| JP | 2000-192195 | A | | 7/2000 |
| JP | 2001-107181 | A | | 1/2001 |
| WO | WO 99/50469 | A | | 10/1999 |
| WO | WO 02/083966 | A1 | | 10/2002 |
| WO | WO 02083966 | A1 | * | 10/2002 |

OTHER PUBLICATIONS

Nakama et al., English machine translation of JP 2000-144339, May 2000.*

Becherer et al., ASM Handbook-Introduction to Heat Treating of Tool Steels, 1991, ASM International, vol. 4, p. 1-25.*

* cited by examiner

*Primary Examiner* — Roy King
*Assistant Examiner* — Caitlin Kiechle
(74) *Attorney, Agent, or Firm* — Sughrue Mion, PLLC

(57) ABSTRACT

A cold die steel excellent in the characteristic of suppressing dimensional change, which has a chemical composition in mass %: C: 0.7% or more and less than 1.6%, Si: 0.5 to 3.0%, Mn: 0.1 to 3.0%, P: less than 0.05% including 0%, S: 0.01 to 0.12%, Cr: 7.0 to 13.0%, one or two elements selected from the group consisting of Mo and W: amounts satisfying the formula (Mo+(W/2))=0.5 to 1.7%, V: less than 0.7% including 0, Ni: 0.3 to 1.5%, Cu: 0.1 to 1.0% and Al: 0.1 to 0.7%. Preferably, the die steel satisfies the formula in mass %: Ni/Al=1 to 3.7. It is preferred that the die steel also satisfies the following formula in mass %: (Cr−4.2×C)=5 or less and (Cr−6.3×C)=1.4 or more and that it contains 0.3% or less of Nb.

7 Claims, 3 Drawing Sheets

COLD DIE STEEL EXCELLENT IN CHARACTERISTIC OF SUPPRESSING DIMENSIONAL CHANGE

CROSS REFERENCE TO RELATED APPLICATIONS

This application is a Continuation application of Ser. No. 10/538,367 filed Jun. 13, 2005 which is now abandoned, which is a 371 National Stage of International Application No. PCT/JP2003/16392 filed Dec. 19, 2003, claiming priority based on Japanese Patent Application No. 2002-373727 filed Dec. 25, 2002, the contents of all of which are incorporated herein by reference in their entirety.

TECHNICAL FIELD

The present invention generally relates to a tool material, and particularly relates to a cold die steel preferably used in a die assembly for molding components for a household electrical appliance, a mobile telephone, an automobile and the like.

BACKGROUND OF THE INVENTION

Conventionally, JIS SKD11 has been in heavy usage for a cold die steel, but some attempts have been made to modify the SKD11 in order to improve machinability, toughness and hardness after secondary hardening. For instance, there proposed are (1) a cold die steel referred to 10% Cr SKD (see JP-A-11-279704) which has improved machinability and toughness, in which amounts of added carbon and chromium are adjusted so as to reduce non-solute carbides while the matrix composition are maintained to be that of SKD11 as much as possible, and (2) a cold die steel referred to 8% Cr SKD (see JP-A-01-011945) which has improved secondary hardening capability, in which an amount of non-solute carbides are reduced and an amount of molybdenum is increased while the matrix composition are maintained to be that of SKD11 as much as possible.

The above described techniques are effective to improve characteristics required for a cold die steel. However, these techniques have problems to cause a large dimensional change in a tempering step. Specifically, a great dilatation in a secondary hardening region in tempering leads to increase working steps after heat treatment.

The dilatational change of dimension in tempering is caused by a release of a residual stress formed in a previous quenching step (by decomposition of retained austenite), and is promoted by precipitation of temper carbides formed by molybdenum and the like which are conventionally added expecting for secondary hardening. In addition, if the retained austenite is restrained by non-solute primary carbides which have been formed in casting and originally existed, the decomposition thereof in the tempering step is suppressed. However, it is preferable to reduce the primary carbides because they are a factor of degrading machinability, and so the reduction thereof promotes the decomposition of the retained austenite and the dimensional change.

SUMMARY OF THE INVENTION

In recent years, in processing industries of a die assembly, the number of working steps before heat treatment is sharply decreased by development in a processing technique, but the number of working and adjusting steps after heat treatment is not so much changed. Thus, improvements in steps after heat treatment become an urgent matter in particular. Accordingly, the present invention is to provide a cold die steel particularly suitable for a tool material, in which dimensional change is suppressed in quenching and tempering, so that the working and adjusting steps after heat treatment can be reduced which has increased the number of die-manufacturing steps.

First, the present inventors searched for techniques of canceling the dimensional change adversely to suppress the dimensional change which has been difficult to sufficiently suppress, under the condition that the target steel maintains all characteristics required for a cold die steel in tempering. Furthermore, they studied in detail the structural change of a matrix during tempering, and discovered that temper carbides themselves do not contribute to secondary hardening so much. Thus, they have found new means for suppressing the dimensional change and also increasing hardness, and could obtain a cold die steel having other characteristics sufficiently as well.

Thus, the present invention provides a cold die steel having a chemical composition described below and excellent characteristics of suppressing the dimensional change.

The cold die steel includes, by mass %, 0.7% or more and less than 1.6% of carbon (C), 0.5 to 3.0% of silicon (Si), 0.1 to 3.0% of manganese (Mn), less than 0.05% including 0% of phosphor (P), 0.01 to 0.12% of sulfur (S), 7.0 to 13.0% of chromium (Cr), one or two elements selected from the group consisting of molybdenum (Mo) and tungsten (W) amounts of which satisfy the formula: $(Mo+(W/2))=0.5$ to 1.7%, less than 0.7% including 0% of vanadium (V), 0.3 to 1.5% of nickel (Ni), 0.1 to 1.0% of copper (Cu), and 0.1 to 0.7% of aluminum (Al).

The cold die steel preferably satisfies the formula by mass %: $Ni/Al=1$ to 3.7%. Furthermore, the cold die steel preferably satisfies the relational formulas by mass %: $(Cr-4.2\times C)=5\%$ or less; and $(Cr-6.3\times C)=1.4\%$ or more. In addition, the cold die steel preferably includes 0.3% or less of columbium (Nb).

Important features of the present invention are to suppress the dimensional change by offsetting it, which has been difficult to be basically suppressed, while the characteristics required of a cold die steel are maintained. Although the above described temper carbides have been used for secondary hardening in spite of being the factor of promoting the dilatational change of dimension in tempering, the inventors discovered that the secondary hardening capability thereof are small through a detailed study of the hardening behavior of the cold work die steel during heat treatment as described above. The present inventors have found means for compensating the shortage of the secondary hardening capability while suppressing the dimensional change. According to the compensation means, the excellent characteristics of suppressing the dimensional change and having high hardness can be achieved without lowering necessary characteristics including machinability and abrasion resistance.

A principle of the present invention is to provide a cold die steel excellent in characteristics of suppressing the dimensional change and having high hardness, which is based on a chemical composition in which the primary carbides are reduced and the dimensional change is suppressed in an extent of satisfying the characteristics, and to which adequate amounts of nickel and aluminum are added, and besides an adequate amount of copper is added corresponding to the amounts of nickel and aluminum.

In the present invention, nickel and aluminum form intermetallic compounds precipitating in a secondary hardening region when the above described tool steel is tempered (aged), which cause a contractional change of dimension, and thereby can cancel the above described dilatation due to the decomposition of the retained austenite. It is important for the above described setoff effect to precipitate the Ni—Al intermetallic compounds at the secondary hardening temperature of the tool steel, and the amount of copper having the effect therefor should be appropriately controlled.

Furthermore, with the use of a transmission electron microscope, the present inventors studied in detail the structural change of the matrix in heat treatment for high-temperature tempering in which the retained austenite decomposes and temper carbides precipitate, which particularly causes many problems of the dilatational change of dimension. As a result, the inventors confirmed that temper carbides which promote the dimensional change greatly contribute to improve abrasion resistance, but can not confirm that fine carbides are precipitated, although they have been conventionally considered to particularly contribute to secondary hardening. They found that the degree of secondary hardening is greatly affected by factors in the matrix.

Ni—Al intermetallic compounds adopted in the present invention have a secondary hardening effect as a precipitation strengthening element, thereby further compensates the secondary hardening in addition to the above described setoff effect of the dimensional change. Thus, excellent resistance to the dimensional change and high hardness characteristics can be achieved without lowering other necessary characteristics such as machinability and abrasion resistance.

The precipitation strengthening method with intermetallic compounds has been conventionally often applied to a maraging steel, but has not been used in the field of a tool steel including 0.2 mass % or more of carbon, and particularly in the field of a cold die steel which relates to the present invention. In addition to the characteristics of canceling a dimensional change, the present inventors knew that temper carbides do not actually have such a high secondary hardening effect on the tool steel in itself as has been considered, and consequently noticed to use such an intermetallic compound. Because nickel and aluminum act individually to lower the required properties of the tool steel, an appropriate composition and alloy design for the tool steel are necessary in consideration of the mutual interaction of them with copper.

Next, a dimensional change generated in quenching will be described. The degree of the dimensional change depends on an amount of a solid solute carbon existing in a matrix when it is quenched. In other words, the dimensional change is generated due to the expansion of crystal lattices by the force of a solute carbon in a martensitic structure. In a conventional steel, an alloy composition is totally designed so that the amount of solid-solute carbon can be in the vicinity of 0.6 (mass %) when quenched, which value is analogous to SKD11. But the cold die steel according to the present invention is designed to have such a composition that the amount of solid-solute carbon is intended to be about 0.53% which is lower than that in the conventional steel.

The design of the composition is achieved by addition of elements such as copper, nickel and aluminum, which decrease the amount of solid-solute carbon. That is a principle of the design for suppressing dilatation in quenching. A preferable conditions of achieving such an amount of solid-solute carbon are, in addition to the basic composition and the appropriate amount of copper, nickel and aluminum to be added which are specified in the present invention, to control amounts of carbon and chromium to be added in the whole cold die steel so as to satisfy the formulas: $(Cr-4.2\times C)=5$ or less, and $(Cr-6.3\times C)=1.4$ or more, preferably $(Cr-6.3\times C)=1.7$ or more.

FIG. 1 shows a summarized concept for the above conditions. (*Note: in FIG. 1, reference character A shows "an effect for suppressing dilatation due to decrease of an amount of solid-solute carbon"; reference character B shows "that the dimensional change are setoff due to precipitation strengthening"; and reference character C denotes "a secondary hardening temperature of the steel according to the present invention.")

The figure shows that the cold die steel according to the present invention causes larger secondary hardening than JIS SKD11, but can suppress the dimensional change more effectively than that. A principle of the present invention is to simultaneously satisfy the two points of: (1) decreasing the amount of solid-solute carbon in quenching (see the reference character A in FIGS. 1); and (2) offsetting a volume change of a matrix in secondary hardening, due to addition of copper, nickel and aluminum (see the reference character B in FIG. 1). Regarding the concept for the item (1), it is most important industrially to control the amount of solid-solute carbon to be approximately 0.53% at a general-purpose quenching temperature of about 1,030° C. Regarding the concept for the item (2), as it is concerned that adding of copper and nickel might degrade hot and cold workabilities, it is important to keep a balance between the level for preventing the degradation thereof and that for causing the maximum precipitation strengthening.

The composition of the cold die steel according to the present invention will be explained below. In the following description, a notation of % means mass percent, for indicating a content of each element.

Carbon (C) is an important element which partly solutes in a matrix to impart strength thereto, and partly forms carbides to improve wear resistance and resistance to seizure. A ratio of an amount of solid-solute carbon to that of carbon in carbides in the steel is mainly determined by an interaction between carbon and chromium, so that the carbon content must be simultaneously specified with chromium content in consideration of the interaction therebetween. However, in order to obtain a practical cold die steel which have well-balanced machinability and heat treatment deformation stability, the amount of carbon is independently in a range of 0.7 to 1.6%, preferably in a range of 0.9 to 1.3%.

Silicon (Si) is an important element for the cold die steel according to the present invention. Although about 0.3% of silicon is normally added as a deoxidizing agent, 0.5% or higher of silicon is added in the present invention which is higher than usual. It is important to prevent a softening of the steel below a tempering temperature of about 490° C., because it is concerned that quenching hardness of the steel may be lowered due to a design of the composition for suppressing the dilatation in quenching. However, as an excessive silicon content causes formation of a delta ferrite, the upper limit is defined to be 3.0%. A preferable amount of silicon is in a range of 0.9 to 2.0%.

Manganese (Mn) is used for a deoxidizing agent as well as silicon, and the steel contains at least 0.1% of manganese. However, as an excessive manganese content lowers machinability, the upper limit is defined to be 3.0%. A preferable amount of manganese is in a range of 0.1 to 1.0%.

Chromium (Cr) is an indispensable element for forming carbides as well as for enhancing hardenability. A ratio of an amount of solute chromium with respect to that of chromium in carbides is determined by interaction between chromium and carbon as in the case of carbon. Thus, the chromium content must be simultaneously specified with the carbon content in consideration of the interaction therebetween. However, in order to obtain a practical cold die steel which has well-balanced machinability and heat treatment deformation stability, an amount of chromium is independently in a range of 7.0 to 13.0%, preferably in a range of 8.0 to 11.0%.

Molybdenum (Mo) and tungsten (W) impart a similar working-effect to the steel, the level of which can be specified by (Mo+(W/2)) in consideration of an atomic weight. Molybdenum and tungsten are considered to play an important role in secondary hardening of a tool steel, so that large amounts of molybdenum and tungsten are added to a high-speed tool steel requiring high hardness, for they are used in small products such as a byte or a drill. In the present invention as well, molybdenum and tungsten are indispensably added because they greatly contribute to a matrix condition for developing secondary hardening. If the content is less than 0.5% a sufficient effect is not obtained. But on the other hand, excessive addition is not preferable for large products such as a cold die assembly because these elements promote the dimensional change as described above. Accordingly, in the cold die steel according to the present invention, an amount of (Mo+(W/2)) is defined to be in a range of 0.5 to 1.7%, preferably in a range of 0.75 to 1.5%.

Aluminum (Al) is coupled with nickel to form a Ni—Al intermetallic compound such as $Ni_3Al$ or NiAl, and causes secondary hardening through its precipitation. A matrix is retracted through the precipitation reaction, which cancels the dilatation reaction in the tool steel in secondary hardening. As a result, the dimensional change is suppressed. Thus, aluminum is an important element in the present invention. However, the aluminum content of less than 0.1% does not provide a sufficient effect, but on the other hand, an excessive content exceeding 0.7% causes a remarkable formation of a delta ferrite, so that an amount of Aluminum is specified to be in a range of 0.1 to 0.7%, preferably in a range of 0.1 to 0.5%, further preferably in a range of 0.15 to 0.45%.

Nickel (Ni) is coupled with aluminum to form a Ni—Al intermetallic compound which precipitates as described above, and simultaneously thereby causes secondary hardening and the suppression of the dimensional change. Thus, nickel is an important element in the present invention. In addition, it is an useful element for preventing red brittleness of the cold die steel according to the present invention which contained copper as described below. The nickel content of less than 0.3% does not provide a sufficient effect, but on the other hand, an excessive content exceeding 1.5% increases a solubility limit of carbon in iron and lowers the workability in an annealed state. Thus, an amount of nickel is specified to be in a range of 0.3 to 1.5%, preferably in a range of 0.4 to 1.5%, further preferably in a range of 0.5 to 1.3%.

Furthermore, if amounts of nickel and aluminum are adjusted so as to satisfy the relationship of Ni/Al=1 to 3.7, amounts of nickel and aluminum in the matrix, which do not form an intermetallic compound, can be adjusted. Thus, the amount of nickel in the matrix can be reduced particularly after the intermetallic compound has been precipitated, so that the steel can keep good machinability after heat treatment (aging). A preferable ratio of nickel to aluminum is 1.2 to 3.7. A more preferable one is in a range of 1.3 to 3.7, and a further preferable one is in a range of 2.5 to 3.5.

As for copper, a metal phase of copper starts to precipitate from a temperature of about 480° C. or higher and forms a nucleus of precipitation for an intermetallic compound, so that it enables the above described Ni—Al intermetallic compound to precipitate just at the vicinity of a secondary hardening temperature of the tool steel, although the compound originally precipitates at a higher temperature. Accordingly, it makes the tool steel according to the present invention develop fully the offset effect of the dimensional change and the secondary hardening effect due to the precipitation of the Ni—Al intermetallic compound. However, as a large amount of copper causes red brittleness, it is important in the present invention to specify the amount thereof to be in a range of 0.1 to 1.0%, preferably in a range of 0.2 to 0.8%.

Sulfur (S) is an useful and indispensable element for the cold die steel according to the present invention, because it improves machinability. However, as an excessive content lowers toughness, the content is in a range of 0.01 to 0.12%, preferably 0.03 to 0.09%.

Columbium (Nb) is a preferable element to be contained for the cold work die steel according to the present invention, because it functions to make carbides distribute uniformly in a structure and reduce deformation due to heat treatment. An amount of columbium is preferably 0.03% or more, but is desirably 0.3% or less, because columbium contained in the steel forms an MX compound and an excessive amount of the compound impairs machinability.

In addition, the following elements may be contained in the steel according to the present invention so far as being controlled in the following range.

Phosphor (P) is controlled to be less than 0.05%, preferably 0.02% or less, because it is an element which lowers toughness. Vanadium (V) can be added to improve hardenability, but it lowers machinability. Thus an amount of vanadium is limited to be less than 0.7%, preferably 0.5% or less, even though it is added.

The present invention provides a cold die steel which satisfies the above described conditions and contains iron (Fe) substantially as the balance. Characteristics of suppressing a dimensional change and excellent secondary hardening are achieved by the cold die steel which consists of, for instance, the above described elements, iron, and other elements of 20% or less, 10% or less, or 5% or less in total, or which consist of the above described elements and the balance of iron with unavoidable impurities.

Examples according to the present invention will be described below with reference to the drawings.

DETAILED DESCRIPTION OF THE INVENTION

Example 1

Figure 1:
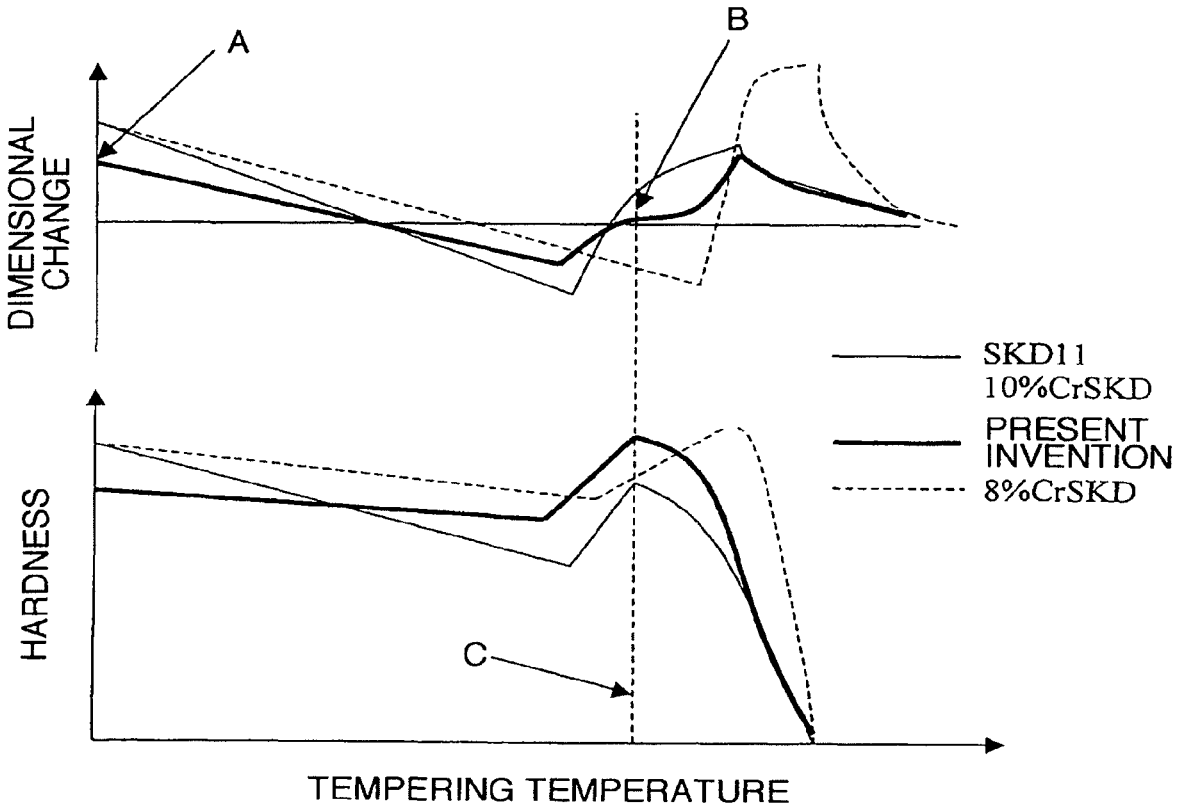
FIG. 1 is a view which shows dimensional changes and hardness due to tempering for cold die steels to explain an effect of the present invention.

Samples No. 1 to 6 according to the present invention and comparative examples No. 7 to 9 were melt with a high-frequency induction heating device in the ambient atmosphere, and formed into ingots with a cross section size of 80×80 mm, each of which has a composition shown in Table 1 with the balance of iron and unavoidable impurities. Here, the sample No. 7 is a material referred to JIS SKD11, while the sample No. 8 is 8% Cr SKD and the sample No. 9 is 10% Cr SKD.

TABLE 1

| | Composition (mass %) | | | | | | | | | | | | | | Mo + | | Cr − | |
|---|---|---|---|---|---|---|---|---|---|---|---|---|---|---|---|---|---|---|
| | C | Si | Mn | P | S | Cr | Mo | W | V | Ni | Cu | Al | Nb | Fe | W/2 | Ni/Al | 4.2C | Cr − 6.3C |
| Present Invention No. 1 | 1.11 | 1.31 | 0.58 | <0.01 | 0.06 | 8.95 | 1.1 | <0.1 | 0.25 | 0.78 | 0.42 | 0.27 | <0.03 | Bal. | 1.1 | 2.889 | 4.288 | 1.957 |
| Present Invention No. 2 | 1.19 | 1.49 | 0.62 | <0.01 | 0.12 | 9.12 | 0.8 | 0.21 | 0.35 | 1.02 | 0.78 | 0.31 | <0.03 | Bal. | 0.905 | 3.290 | 4.122 | 1.623 |
| Present Invention No. 3 | 0.72 | 1.51 | 0.61 | <0.01 | 0.06 | 7.20 | 1.0 | 0.13 | 0.21 | 0.81 | 0.49 | 0.28 | <0.03 | Bal. | 1.065 | 2.893 | 4.176 | 2.664 |
| Present Invention No. 4 | 1.51 | 1.52 | 0.64 | <0.01 | 0.01 | 12.3 | 1.25 | 0.32 | <0.1 | 1.02 | 0.61 | 0.29 | <0.03 | Bal. | 1.410 | 3.517 | 5.958 | 2.787 |
| Present Invention No. 5 | 1.18 | 1.05 | 0.57 | <0.01 | 0.06 | 10.4 | 0.88 | 0.24 | <0.1 | 0.79 | 0.54 | 0.26 | <0.03 | Bal. | 1.000 | 3.038 | 5.444 | 2.966 |
| Present Invention No. 6 | 1.02 | 1.51 | 0.56 | <0.01 | 0.07 | 8.40 | 0.91 | <0.1 | <0.1 | 0.52 | 0.39 | 0.35 | 0.13 | Bal. | 0.91 | 1.486 | 4.116 | 1.974 |
| Comparative Example No. 7 | 1.49 | 0.35 | 0.38 | <0.01 | <0.01 | 12.2 | 1.04 | 0.35 | 0.25 | <0.01 | <0.01 | <0.01 | <0.03 | Bal. | 1.215 | | 5.942 | 2.813 |
| Comparative Example No. 8 | 0.98 | 1.11 | 0.41 | <0.01 | <0.01 | 7.95 | 1.98 | 0.30 | 0.25 | <0.01 | <0.01 | <0.01 | <0.03 | Bal. | 2.130 | | 3.834 | 1.776 |
| Comparative Example No. 9 | 1.18 | 0.39 | 0.42 | <0.01 | 0.06 | 10.2 | 1.02 | 0.25 | 0.25 | <0.01 | <0.01 | <0.01 | <0.03 | Bal. | 1.145 | | 5.244 | 2.766 |

At first, these ingots were hot-worked into a wire material with a cross section size of 15 mm×15 mm. They were then annealed, and test pieces of 8 mmϕ×80 mmL were formed, and the longitudinal dimensions thereof were measured. Then, they were quenched at 1,030° C. (nitrogen cooling at a pressure of 0.506 MPa), and subsequently subjected to high-temperature tempering twice to be secondary hardened so as to have a hardness around 60 to 63 HRC. The dimensions were measured again at this condition. The sample No. 8 (8% Cr SKD) is secondary hardened at a tempering temperature of about 525° C., and the other samples are secondary hardened at a tempering temperature of about 510° C. All samples of No. 1 to 6 after heat treatment have higher hardness than that of SKD11 (No. 7), which means that those samples have excellent secondary hardening capability.

Figure 2:
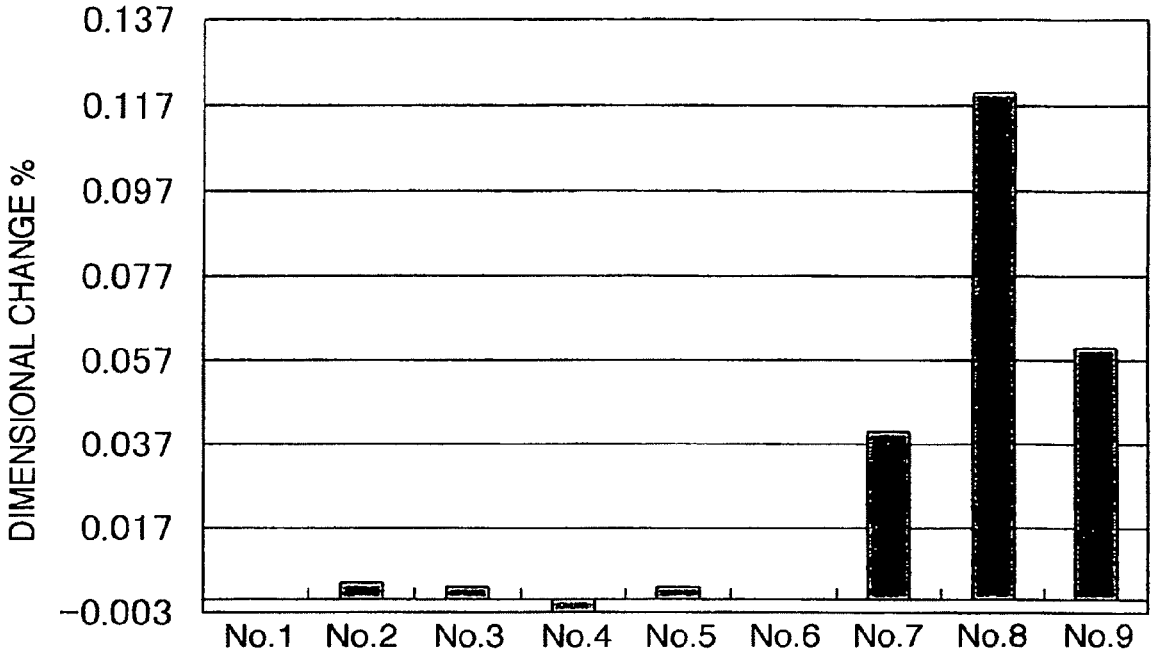
FIG. 2 is a view showing dimensional changes of cold die steels due to heat treatment.

FIG. 2 shows a dimensional change of each sample due to heat treatment, or, a dimensional change during secondary hardening. The dimensional change during heat treatment was calculated from the measurements on longitudinal dimensions before and after the above described heat treatment, by using the following formula.

$$\text{dimensional change during heat treatment} = ((\text{dimension after heat treatment} - \text{dimension before heat treatment}) / \text{dimension before heat treatment}) \times 100$$

The sample No. 8 has the largest dilatation and shows the largest dimensional change. This is because it contains excessive molybdenum. The samples No. 7 and 9 have compositions adequately adjusted to have an amount of molybdenum equivalent of (Mo+(W/2)) being about 1.0%, but still cause the dilatation around 0.05%. In contrast, the samples of No. 1 to 6 containing the appropriate amounts of nickel, copper and aluminum show the dimensional change due to heat treatment controlled to be 0.01% or less. The result shows that a precipitation reaction of Ni—Al intermetallic compounds in a secondary hardening region offsets the dilatation.

Example 2

Figure 3A:
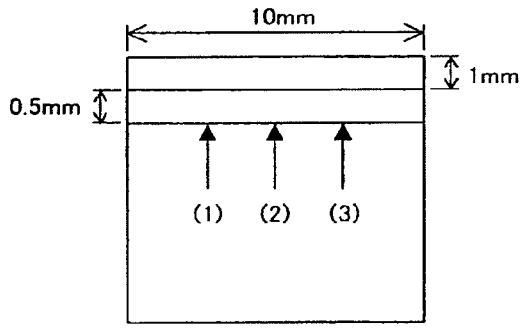
FIG. 3A is a front view of a test piece used in an example according to the present invention, for measuring a quantity of torsion of cold die steels due to heat treatment.
Figure 3B:
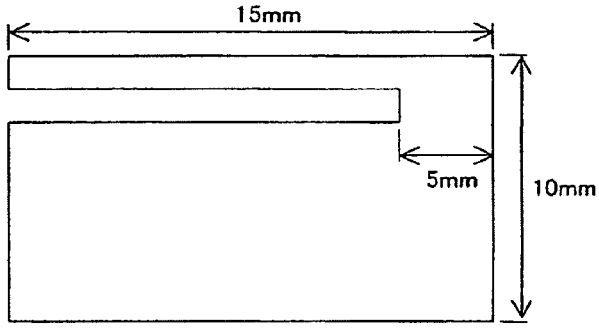
FIG. 3B is a side view of a test piece used in an example according to the present invention, for measuring a quantity of torsion of cold die steels due to heat treatment.

A test piece having a form shown in FIGS. 3A (front view) and 3B (side view) was produced from the annealed steels. In FIG. 3A, each clearance (gap size) at the positions of arrow (1) (at 2.5 mm from the left), arrow (2) (at 5.0 mm from the left) and arrow (3) (at 7.5 mm from the left) is 0.5 mm. The test pieces were then heat-treated in the same way as in Example 1, and the clearances at the same positions were measured again. A "quantity of torsion" was determined from changes of the clearances based on the following formula;

$$\text{quantity of torsion (absolute value)} = |(\text{average variation of (1) to (3)}) - (\text{the further value from the above described average value, selected from values (1) and (3)})|.$$

Figure 4:
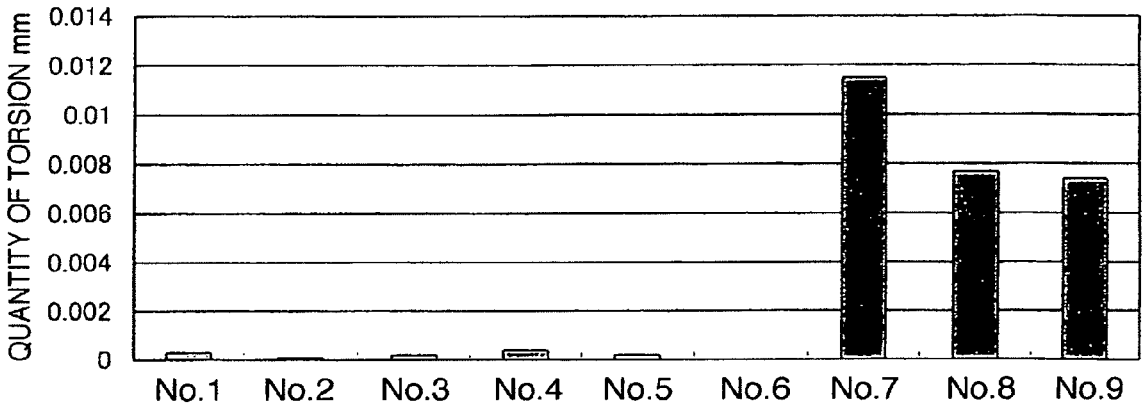
FIG. 4 is a view showing a quantity of torsion of cold die steels due to heat treatment.

The results of the calculated quantities of torsion are shown in FIG. 4. The sample No. 7 has the largest quantity of torsion. This is because the sample contains a large amount of solid-solute carbon in the martensite and a large amount of non-solute carbide, and thereby a strong inner stress is generated by the dilatation of the matrix and the restraint by the non-solute carbides. The samples No. 8 and 9 have a large quantity of torsion in spite of containing few non-solute carbides, but the samples of No. 1 to 6, in which the inner stress of the matrix is offset by the precipitation of Ni—Al intermetallic compounds, obviously have small quantities of torsion. Furthermore, the sample No. 6 containing the appropriate amount of columbium provides an adequate result that torsion was not measured within the measurement accuracy of ±0.0001 mm.

The tool steel in the present invention are not dimensional changed and deformed due to heat treatment, and makes it possible to reduce/omitted finish working for correction after heat treatment. Thus, manufacturing cost for the die assembly can be reduced. The tool steel further make it possible to shorten a period for manufacturing the die assembly, and to heat treat a die having a more complicated shape, so that the present invention is an industrially extremely useful technology.

INDUSTRIAL APPLICABILITY

The cold die steel according to the present invention is preferably used as a tool material for forming components in machines.

The invention claimed is:

1. A cold die steel excellent in characteristics of suppressing dimensional change, consisting of, by mass %,
carbon (C): 0.7% or more and less than 1.6%,
silicon (Si): 0.5 to 3.0%,
manganese (Mn): 0.1 to 3.0%,
phosphor (P): less than 0.05% including 0%,
sulfur (S): 0.01 to 0.12%,
chromium (Cr): 7.0 to 9.12%,
one or two elements selected from the group consisting of molybdenum (Mo) and tungsten (W): amounts satisfying the formula: (Mo+(W/2))=0.5 to 1.7%,
vanadium (V): less than 0.7% including 0%,
nickel (Ni): 0.3 to 1.5%,
copper (Cu): 0.1 to 1.0%,
aluminum (Al): 0.1 to 0.7%, and
the balance being iron and unavoidable impurities,
wherein amounts of nickel and aluminum satisfy the formula: Ni/Al=1 to 3.7, and
wherein amounts of chromium and carbon satisfy the formulas by mass %: (Cr−4.2×C)=5 or less, and (Cr−6.3×C)=1.4 or more.

2. A cold die steel excellent in characteristics of suppressing dimensional change, consisting of, by mass %,
carbon (C): 0.7% or more and less than 1.6%,
silicon (Si): 0.5 to 3.0%,
manganese (Mn): 0.1 to 3.0%,
phosphor (P): less than 0.05% including 0%,
sulfur (S): 0.01 to 0.12%,
chromium (Cr): 7.0 to 9.12%,
one or two elements selected from the group consisting of molybdenum (Mo) and tungsten (W): amounts satisfying the formula: (Mo+(W/2))=0.5 to 1.7%,
vanadium (V): less than 0.7% including 0%,
nickel (Ni): 0.3 to 1.5%,
copper (Cu): 0.1 to 1.0%,
aluminum (Al): 0.1 to 0.7%,
columbium (Nb): 0.3% or less excluding 0%, and
the balance being iron and unavoidable impurities,
wherein amounts of nickel and aluminum satisfy the formula: Ni/Al=1 to 3.7, and
wherein amounts of chromium and carbon satisfy the formulas: (Cr−4.2×C)=5 or less, and (Cr−6.3×C)=1.4 or more, and
wherein the steel includes solid-solute carbon of about 0.53%,
whereby nickel and aluminum forms an intermetallic compound through quenching and tempering.

3. A cold die steel excellent in characteristics of suppressing dimensional change, consisting of, by mass %,
carbon (C): 0.7% or more and less than 1.6%,
silicon (Si): 0.5 to 3.0%,
manganese (Mn): 0.1 to 3.0%,
phosphor (P): less than 0.05% including 0%,
sulfur (S): 0.01 to 0.12%,
chromium (Cr): 7.0 to 13.09.12%,
one or two elements selected from the group consisting of molybdenum (Mo) and tungsten (W): amounts satisfying the formula: (Mo+(W/2))=0.5 to 1.7%,
vanadium (V): less than 0.7% including 0%,
nickel (Ni): 0.3 to 1.5%,
copper (Cu): 0.1 to 1.0%,
aluminum (Al): 0.1 to 0.7%, and
the balance being iron and unavoidable impurities,
wherein amounts of nickel and aluminum satisfy the formula: Ni/Al=1 to 3.7, wherein the steel further includes by mass %, 0.3% or less excluding 0% of columbium per (Nb), and
wherein amounts of chromium and carbon satisfy the formulas by mass %: (Cr−4.2×C)=5 or less, and (Cr−6.3×C)=1.4 or more.

4. A method for suppressing dimensional change of a cold die steel, where the steel is claimed in claim 1, the method comprising
preparing an ingot of the steel, the steel consisting of, by mass %,
carbon (C): 0.7% or more and less than 1.6%,
silicon (Si): 0.5 to 3.0%,
manganese (Mn): 0.1 to 3.0%,
phosphor (P): less than 0.05% including 0%,
sulfur (S): 0.01 to 0.12%,
chromium (Cr): 7.0 to 9.12%,
one or two elements selected from the group consisting of molybdenum (Mo) and tungsten (W): amounts satisfying the formula: (Mo+(W/2))=0.5 to 1.7%,
vanadium (V): less than 0.7% including 0%,
nickel (Ni): 0.3 to 1.5%,
copper (Cu): 0.1 to 1.0%,
aluminum (Al): 0.1 to 0.7%, and
the balance being iron and unavoidable impurities,
wherein amounts of nickel and aluminum satisfy the formula by mass %:
Ni/Al=1 to 3.7, and
wherein amounts of chromium and carbon satisfy the formulas by mass %: (Cr−4.2×C)=5 or less, and (Cr−6.3×C)=1.4 or more;
hot working the ingot,
annealing the worked steel,
quenching the annealed steel,
tempering the quenched steel so that nickel and aluminum form an intermetallic compound.

5. The method according to claim 4,
wherein the quenching is performed from about 1030° C. whereby an amount of solid-solute carbon becomes about 0.53%.

6. The method according to claim 4, wherein the tempering comprises heating the steel at about 510° C.

7. A method for suppressing dimensional change of a cold die steel, where the steel is claimed in claim 1, the method comprising
preparing an ingot of the steel, the steel consisting of, by mass %,
carbon (C): 0.7% or more and less than 1.6%,
silicon (Si): 0.5 to 3.0%,
manganese (Mn): 0.1 to 3.0%, phosphor (P): less than 0.05% including 0%,
sulfur (S): 0.01 to 0.12%,
chromium (Cr): 7.0 to 9.12%,
one or two elements selected from the group consisting of molybdenum (Mo) and tungsten (W): amounts satisfying the formula: (Mo+(W/2))=0.5 to 1.7%,
vanadium (V): less than 0.7% including 0%,
nickel (Ni): 0.3 to 1.5%,
copper (Cu): 0.1 to 1.0%,
aluminum (Al): 0.1 to 0.7%, and
the balance being iron and unavoidable impurities,
wherein amounts of nickel and aluminum satisfy the formula by mass %:
Ni/Al=1 to 3.7, and
wherein amounts of chromium and carbon satisfy the formulas by mass %: (Cr−4.2×C)=5 or less, and (Cr−6.3×C)=1.4 or more;
hot working the ingot,
annealing the worked steel,
quenching the annealed steel,
tempering the quenched steel so that nickel and aluminum form an intermetallic compound, wherein the steel further includes, by mass %, 0.3% or less excluding 0% of columbium (Nb).

* * * * *